United States Patent [19]

Hutton et al.

[11] Patent Number: 4,862,541

[45] Date of Patent: Sep. 5, 1989

[54] DEVICE FOR ATTACHING A SHEET TO A MATTRESS

[76] Inventors: William B. Hutton; Deanice B. Hutton, both of 58481 Ross Rd., Warren, Oreg. 97033

[21] Appl. No.: 193,817

[22] Filed: May 12, 1988

[51] Int. Cl.[4] ..... A47G 9/04

[52] U.S. Cl. ..... 5/496

[58] Field of Search ..... 5/508, 496, 498, 504; 24/72.5, 302, 298

[56] References Cited

U.S. PATENT DOCUMENTS

| | | | |
|---|---|---|---|
| 557,456 | 3/1876 | Utter | 24/72.5 X |
| 1,156,740 | 10/1915 | Berdan | 24/72.5 |
| 1,602,305 | 10/1926 | Helm | 24/72.5 |
| 2,630,588 | 3/1953 | Levin | 5/496 |
| 2,791,784 | 5/1957 | Tomsic | 5/496 |
| 2,857,643 | 10/1958 | Tomsic | 5/496 X |
| 3,092,848 | 6/1963 | Gronvold | 24/72.5 X |
| 3,765,040 | 10/1973 | Holstein | 5/496 X |
| 4,624,022 | 11/1986 | Dolan | 24/72.5 X |
| 4,660,240 | 4/1987 | Hutton et al. | 24/72.5 X |
| 4,782,543 | 11/1988 | Hutton et al. | 5/508 |

FOREIGN PATENT DOCUMENTS

| | | | |
|---|---|---|---|
| 727270 | 3/1955 | United Kingdom | 5/498 |

*Primary Examiner*—Gary L. Smith
*Assistant Examiner*—Eric K. Nicholson
*Attorney, Agent, or Firm*—Dellett, Smith-Hill and Bedell

[57] ABSTRACT

A device for attaching a sheet to a mattress comprises an elongate, inextensible strap having first and second opposite ends. The strap is positionable under the mattress across a corner thereof with the first and second opposite ends projecting beyond the two edges respectively. A first fastener is attachable to the strap at the first end thereof and comprises a plate member and a stud. The plate member has two opposite sides and is formed with an elongate opening extending therethrough. The opening has two regions, one of which is narrower than the other. The stud has a base portion, a head portion and a neck portion. The neck portion connects the base portion and the head portion. The base portion is sized to pass through the wider region of the opening, but both the head portion and the base portion are too large to pass through the narrower region. The neck portion is sufficiently narrow to enter the narrower region of the opening. A second fastener is attachable to the strap at the second end thereof.

10 Claims, 1 Drawing Sheet

DEVICE FOR ATTACHING A SHEET TO A MATTRESS

BACKGROUND OF THE INVENTION

This invention relates to a device for attaching a sheet to a mattress.

A conventional bed comprises a generally rectangular mattress, which rests on a support structure. When the bed is made, a bottom sheet is placed on the mattress and is tucked in between the mattress and the support structure around all four edges of the mattress, a top sheet is placed over the bottom sheet and is tucked in at the foot of the bed and along most of two sides of the bed, and blankets or other bedcovers are placed over the top sheet.

The top sheet that is used with conventional mattresses is flat, i.e., it will lie flat, without folding, when spread out on a flat surface. However, it is conventional to employ a fitted sheet as the bottom sheet. A fitted sheet is not flat but is formed with pockets at the corners so that it will fit snugly about the mattress. The advantage of a fitted bottom sheet is that it normally stays securely in position. One difficulty with fitted sheets is that a fitted sheet for one size mattress cannot be fitted to a larger sized mattress, and the advantage of a fitted sheet is largely lost if it is fitted to a smaller sized mattress. Also, in recent years many mattress manufacturers have made mattresses that are thicker than those that they previously made, and sheepskin and so-called egg box mattress pads, which are thicker than the mattress pads that were previously used, have been introduced. Fitted sheets that have been made to fit a previously-conventional mattress, provided with a previously-conventional mattress pad, will not fit easily over a thick mattress that is provided with a thick pad.

U.S. Pat. No. 4,660,240 discloses a device for attaching sheets to a waterbed. A waterbed mattress contains water, and the support structure of a waterbed is normally in the form of a box-like frame in which the mattress is disposed. One attachment device is provided at each corner of the mattress. The attachment device comprises a short length of elastic tape, which is attached at one end to the frame, e.g. by means of a screw. At its other end, the elastic tape is attached to a two-part fastener. The two-part fastener is able to grip releasably one or two bed sheets. The two fasteners at the foot of the bed grip both the top and bottom sheets, while the fasteners at the head of the bed grip only the bottom sheet. The sheets are thus kept in position on the bed, without need for using fitted sheets.

U.S. patent application Ser. No. 07/034,424 filed April 3, 1987, now U.S. Pat. No. 4,782,543 show another attachment device for use with waterbeds. The device shown in that patent application comprises a generally flat retainer portion which is placed under the mattress, adjacent its corner. The weight of the mattress at its corner keeps the retainer portions in position. A strap extends from the retainer portion, and a two-piece fastener, similar to that shown in U.S. Pat. No. 4,660,240, is attached to the strap at its outer end. The strap is long enough that the retainer portion can remain under the mattress while the two-piece fastener is positioned close to the top of the mattress.

Neither of the sheet attachment devices referred to above is suitable for use with a bed having a spring or foam mattress With regard to U.S. Pat. No. 4,660,240, conventional beds having spring or foam mattresses do not have the type of frame that is used in a conventional waterbed, and it is not convenient to attach the elastic tape to the support structure of a conventional bed. With regard to the pending application, a spring or foam mattress often does not lie firmly on its support structure at its corners, and accordingly the retainer portion is not held in position sufficiently firmly.

It is known to attach a bed sheet to a spring or foam mattress by use of an attachment device comprising two garter clips secured to opposite ends of an elastically-extensible strap. A garter clip is not satisfactory for attachment of a bed sheet because stresses are concentrated over a very small area of the fabric of the sheet, and the tension in the sheet when the bed is in use often results in the garter clip tearing the fabric of the sheet. Moreover, because the strap is elastically extensible, the sheet is not held firmly in position. Furthermore, the attachment device cannot be used for attachment of both a top sheet and a bottom sheet, because the garter clip is only able to accommodate a single sheet.

SUMMARY OF THE INVENTION

A preferred embodiment of the present invention is a device for attaching a sheet to a mattress having at least one corner defined between two edges of the mattress. The device comprises an elongate, inextensible strap having first and second opposite ends. The strap is positionable under the mattress across the corner thereof with the first and second opposite ends projecting beyond the two edges respectively. A first fastener is attachable to the strap at the first end thereof and comprises a plate member and a stud. The plate member has two opposite sides and is formed with an elongate opening extending therethrough. The opening has two regions, one of which is narrower than the other. The stud has a base portion, a head portion and a neck portion The neck portion connects the base portion and the head portion. The base portion is sized to pass through the wider region of the opening, but both the head portion and the base portion are too large to pass through the narrower region. The neck portion is sufficiently narrow to enter the narrower region of the opening. A second fastener is attachable to the strap at the second end thereof.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 1:
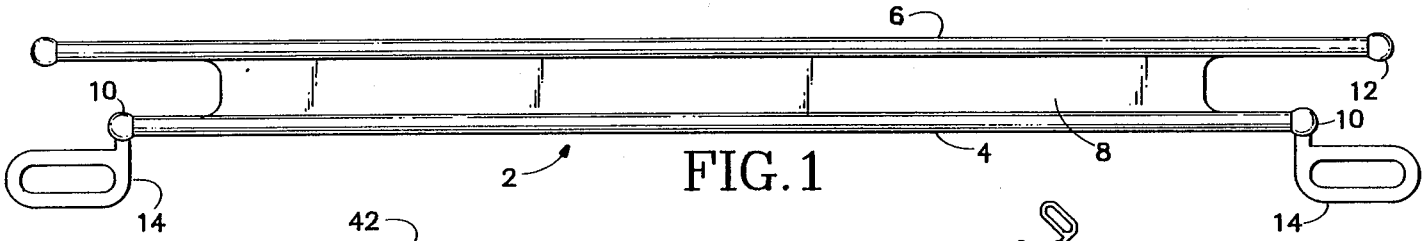
FIG. 1 is a plan view of the strap of a sheet attachment device embodying the present invention.
Figure 2:
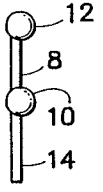
FIG. 2 is an end view of the strap shown in FIG. 1.
Figure 4:
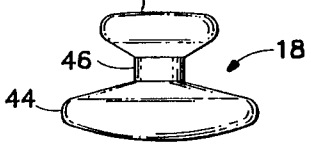
FIG. 4 is a side elevation of another part of the fastener.
Figure 3:
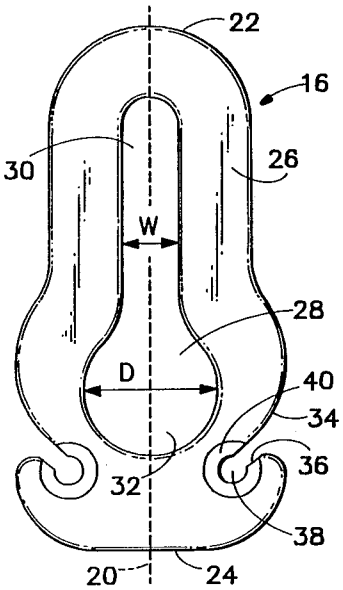
FIG. 3 is a plan view of part of a fastener of a sheet attachment device embodying the present invention.

The illustrated sheet attachment device comprises a strap 2 (FIGS. 1 and 2) and two-part fasteners (FIGS. 3 and 4). The strap 2 comprises two rods 4 and 6 and a web 8 which connects the two rods together. The rod 4 is formed with a knob 10 at each end, and similarly the rod 6 is formed with a knob 12 at each end. When the strap lies flat as shown, the centers of the two knobs at one end of the strap lie on a line that is at approximately 90o to the line on which the centers of the knobs at the other end of the strap lie. A loop 14 projects from each of the knobs 10. The strap 2 is flexible but is substantially inextensible, and is formed by injection molding of synthetic polymer material, e.g. the material sold under the designation Shell KRATON 78 20 G.

Each fastener is similar to the fastener shown in U.S. Pat. No. 4,660,240 and comprises a plate 16 (FIG. 3) and a stud 18 (FIG. 4). The plate 16 is symmetrical about an axis 20 and has an upper end 22 and an opposite lower end 24. The plate 16 has two major faces 26 and is formed with a keyhole-like opening 28. The plate 16 is about 0.32 cm thick and the edges that bound the opening 28 are smoothly rounded. The opening 28 has a slot-form region 30 and a circular region 32. The diameter D of the circular region 32 is greater than the width W of the slot-form region 30. The sides of the slot-form region 30 may converge slightly towards the end farther from the circular region 32. The plate 16 is formed near its lower end 24 with two notches 34. The notches 34 each have two sides which converge slightly and lead through a throat 36 into a region 38 that is part-circular in form. The faces 26 of the plate 16 are slightly recessed surrounding each of the part-circular regions 38, as shown at 40. Each notch 34 is sized to receive the rod 4 or 6. The rod must be deformed slightly in order to pass through the throat 36 into the part-circular region 38, and therefore the rod is retained securely in the notch. When the rod 4 or 6 is fitted in one of the notches, the knob 10 or 12 can be seated in the recess 40.

The stud 18 comprises a base portion 42, a head portion 44 and a neck portion 46. The stud is circularly symmetrical, with the diameter of the base portion (about 1.82 cm) being larger than that of the neck portion (about 0.81 cm) and smaller than that of the head portion (about 3.18 cm). The diameter of the base portion 42 is slightly smaller than the diameter D of the circular region 32 of the opening 28, and the diameter of the neck portion 46 is slightly smaller than the width W of the slot-form region 30 of the opening 28. The diameter of the head portion 44 of the stud is larger than the diameter D of the circular region 32.

Figure 6:
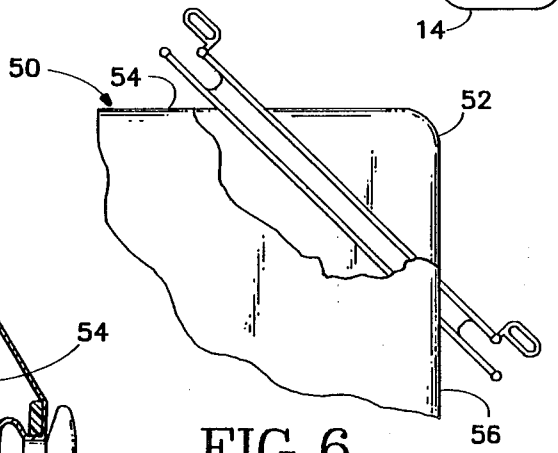
FIGS. 5 and 6 show use of the attachment device to attach a bed sheet to a mattress.
Figure 5:
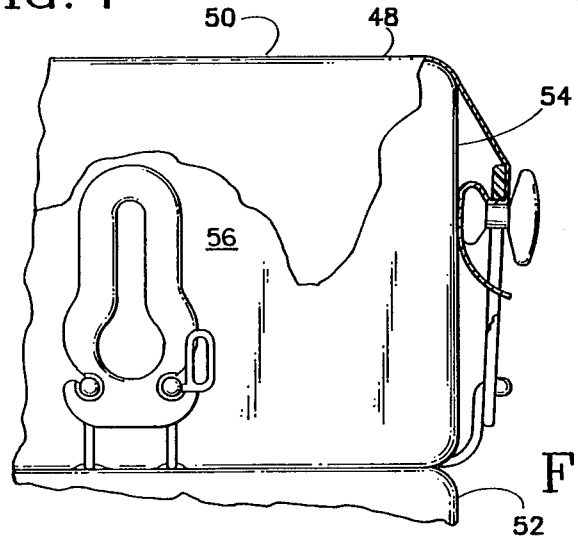

Referring now to FIGS. 5 and 6, the sheet attachment device is used to attach a bottom sheet 48 to a mattress 50 which is resting on a box spring 52 or other support structure. The strap 2 is placed diagonally under a corner region of the mattress, with the rods 4 and 6 at about 45° to the two edges 54 and 56 of the mattress and the shorter rod 4 closer to the corner. The ends of the strap project beyond the edges 54 and 56 of the mattress. The strap is positioned so that when the fasteners are attached to the two ends of the strap and the two ends are bent upwards, as shown in FIG. 5, the fasteners lie somewhat below the top surface of the mattress. In this position, the centers of the two knobs 10 and 12 at each end of the strap lie on a horizontal line, and accordingly the slot-form region 30 is disposed substantially vertically. The bottom sheet 48 is placed over the mattress so that its edge regions lie over the two fasteners respectively. The sheet is attached to one of the fasteners by holding the plate 16 in position with the edge region of the flat sheet draped over it, and inserting the base portion 42 of the stud through the circular region 32 of the opening 28. A small part of the sheet is forced through the circular region 32 of the opening. The stud is then slid into the slot-form region 30 with the sheet surrounding the neck portion 46 of the stud. This operation is repeated for the other fastener of the attachment device, and other attachment devices are installed in similar fashion at the other three corners of the mattress. Because the strap 2 does not stretch longitudinally, the fasteners are not able to move upwards relative to the mattress when tension is applied to the sheet. Moreover, provided the longitudinal margins of the sheet, between the corners of the mattress, are taut when the attachment devices are installed, the fasteners cannot move closer to the corners, such as to create slack in the strap 2. It will therefore be seen that by use of an attachment device at each corner of the mattress, the bottom sheet is firmly attached to the mattress. Of course, in the case of the two corners at the foot of the bed, the top sheet is attached simultaneously with the bottom sheet.

When the stud is not fitted in the opening 28, it can be kept convenient to hand by fitting its base portion through one of the loops 14.

The illustrated attachment device may be used to attach flat sheets securely to a bed. The attachment device may also be used in conjunction with fitted sheets, particularly if the fitted sheets do not fit the mattress properly. For example, if a fitted (or flat) sheet is not large enough that its margin hangs down to the level of the fasteners shown in FIG. 5, e.g., because the mattress is thicker than usual or a thick mattress pad is used, by moving the attachment device closer to the corner of the mattress the fasteners will be raised, allowing them to receive a portion of the smaller sheet.

It will be appreciated that the present invention is not restricted to the particular embodiment that has been described and illustrated, and that variations may be made therein without departing from the scope of the invention as defined in the appended claims and equivalents thereof. For example, the invention is not limited to the use of knobs and notches to secure the fasteners to the strap.

We claim:

1. A device for attaching a sheet to a mattress having at least one corner defined between first and second edges of the mattress, comprising:

an elongate strap having first and second opposite ends, the strap being positionable under the mattress across the corner thereof with the first and second opposite ends projecting beyond the first and second edges respectively, a first fastener which is attachable to the strap at the first end thereof, for positioning at the first edge of the mattress and for attachment to the sheet, the first fastener comprising:

(i) a plate member formed with an elongate opening extending therethrough, the opening having a first length region and a second length region and the second length region being narrower than the first length region, and (ii) a stud having a base portion, a head portion, and a neck portion which connects the base portion and the head portion, the head and base portions each being too large to pass through the second region of the opening but the base portion being sized to pass through the first region of the opening, and the neck portion being sufficiently narrow to enter the second region of the opening, and a second fastener which is attachable to the strap at the second end thereof, for positioning at the second edge of the mattress and for attachment to the sheet.

2. A device according to claim 1, wherein the strap comprises two rod portions each ending in an enlarged knob at the first end of the strap, and wherein the plate member is formed with notches for receiving the rod portions, the notches being sufficiently small that the knobs cannot pass therethrough.

3. A device according to claim 2, wherein the knobs have centers and the rod portions have central axes, and the lengths of the rod portions are unequal and are such that when the central axes are straight and lie in a common plane with the centers of the knobs, the centers of the knobs at the first end of the strap lie on a line at 45° to the central axes of the rod portions.

4. A device according to claim 2, wherein the strap further comprises a web which joins the two rod portions.

5. A device according to claim 2, wherein each notch has a throat portion of which the width is slightly less than the thickness of the rod portions, whereby the rod portions must be deformed in order to be received in the notches.

6. A bed comprising:

a mattress having at least one corner defined between first and second edges of the mattress, a support structure on which the mattress is positioned, a substantially inextensible elongate strap having first and second opposite ends, the strap extending between the mattress and the support structure across the corner of the mattress with the first and second opposite ends of the strap projecting beyond the first and second edges respectively, a sheet positioned over the mattress and having first and second edge regions, a first fastener which is attached to the strap at the first end thereof and is attached to the sheet at the first edge region thereof, and a second fastener which is attached to the strap at the second end thereof and is attached to the sheet at the second edge region thereof.

7. A bed according to claim 6, wherein the first fastener comprises:

(i) a plate member formed with an elongate opening extending therethrough, the opening having a first length region and a second length region and the second length region being narrower than the first length region, and (ii) a stud having a base portion, a head portion, and a neck portion which connects the base portion and the head portion, the head and base portions each being too large to sized to pass through the first region of the opening, and the neck portion being sufficiently narrow to enter the second region of the opening.

8. A bed according to claim 7, wherein the first length region of the opening is a circular region and the second length region of the opening is a slot-form region.

9. A bed according to claim 7, wherein the strap comprises two rod portions each ending in an enlarged knob at the first end of the strap, and wherein the plate member is formed with notches for receiving the rod portions, the notches being sufficiently small that the knobs cannot pass therethrough.

10. A bed according to claim 9, wherein the knobs have centers and the rod portions have central axes, and the lengths of the rod portions are unequal and are such that when the central axes are straight and lie in a common plane with the centers of the knobs, the centers of the knobs at the first end of the strap lie on a line at 45° to the central axes of the rod portions.

* * * * *

UNITED STATES PATENT AND TRADEMARK OFFICE

CERTIFICATE OF CORRECTION

PATENT NO. : 4,862,541

DATED : September 5, 1989

INVENTOR(S) : William B. Hutton et al

It is certified that error appears in the above-identified patent and that said Letters Patent is hereby corrected as shown below:

Column 1, line 67, after "mattress" insert a period (.).

Column 2, line 37, after "portion" (third occurrence) insert a period (.).

Column 3, line 3, delete "90o" and substitute --90°--.

Column 6, line 17, between "to" and "sized" insert --pass through the second region of the opening but the base portion being--.

Signed and Sealed this

Fourteenth Day of May, 1991

*Attest:*

*Attesting Officer*

HARRY F. MANBECK, JR.

*Commissioner of Patents and Trademarks*